US008172684B2

(12) United States Patent
Adiraju et al.

(10) Patent No.: US 8,172,684 B2
(45) Date of Patent: May 8, 2012

(54) NETWORKS FOR USE IN GAMING

(75) Inventors: Srinivyasa M. Adiraju, Vernon Hills, IL (US); Dale R. Buchholz, Palatine, IL (US); Mark B. Gagner, West Chicago, IL (US); Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 819 days.

(21) Appl. No.: 12/097,857

(22) PCT Filed: Dec. 12, 2006

(86) PCT No.: PCT/US2006/047406

§ 371 (c)(1),
(2), (4) Date: Jun. 17, 2008

(87) PCT Pub. No.: WO2007/075332

PCT Pub. Date: Jul. 5, 2007

(65) Prior Publication Data

US 2008/0293494 A1 Nov. 27, 2008

Related U.S. Application Data

(60) Provisional application No. 60/743,074, filed on Dec. 23, 2005, provisional application No. 60/744,954, filed on Apr. 17, 2006.

(51) Int. Cl.
*A63F 9/24* (2006.01)

(52) U.S. Cl. ..... 463/42; 463/43; 463/40; 463/20; 463/25

(58) Field of Classification Search ..... 463/40, 463/42, 20, 25, 43
See application file for complete search history.

(56) References Cited

U.S. PATENT DOCUMENTS

| | | | | |
|---|---|---|---|---|
| 5,941,773 | A * | 8/1999 | Harlick | 463/26 |
| 6,074,300 | A * | 6/2000 | Hirano et al. | 463/43 |
| 6,361,437 | B1 * | 3/2002 | Walker et al. | 463/23 |
| 6,760,774 | B1 * | 7/2004 | Soumiya et al. | 709/233 |
| 2005/0192099 | A1 * | 9/2005 | Nguyen et al. | 463/42 |
| 2008/0300046 | A1 * | 12/2008 | Gagner et al. | 463/25 |

OTHER PUBLICATIONS

"International Search Report for Application No. PCT/US2006/47406, date mailed Mar. 3, 2008", 6 pgs.
"Written Opinion of the International Searching Authority for Application No. PCT/US2006/47406, date mailed Mar. 3, 2008", 9 pgs.

* cited by examiner

*Primary Examiner* — Dmitry Suhol
*Assistant Examiner* — Brandon Gray
(74) *Attorney, Agent, or Firm* — Schwegman, Lundberg & Woessner, P.A.

(57) ABSTRACT

According to one example embodiment disclosed herein, a connection is established between a network and a plurality of gaming units located in a gaming establishment, wherein each gaming unit includes at least one wagering input unit; wherein the network includes one or more network resources and is connected to at least some of the plurality of gaming units; and a gaming information traffic is transmitted on the network.

26 Claims, 18 Drawing Sheets

NETWORKS FOR USE IN GAMING

RELATED APPLICATIONS

This patent application is a U.S. National Stage Filing under 35 U.S.C. 371 from International Patent Application Serial No. PCT/US2006/047406, filed Dec. 12, 2006, and published on Jul. 5, 2007 as WO 2007/075332 A2 and republished as WO 2007/075332 A3, which claims the benefit of priority of U.S. Provisional Patent Application Ser. No. 60/743,074 filed on Dec. 23, 2005 and entitled "Networks For Use In Gaming" and of U.S. Provisional Patent Application Ser. No. 60/744,954 filed on Apr. 17, 2006 and entitled "Networks For Use In Gaming", the contents of which are hereby incorporated by reference in their entirety.

COPYRIGHT

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2005, 2006, WMS Gaming, Inc.

FIELD

Embodiments of the inventive subject matter relate generally to networks used to support wagering game machines and systems, and more particularly, to network security, management and optimization in relation to wagering game machines and systems, among other things.

BACKGROUND

Wagering games are increasingly deployed as part of or as supported by a network in a casino or other gaming establishment. There are a number of network deployment, management, optimization, security and other challenges in the gaming environment that are addressed by the subject matter disclosed herein.

DETAILED DESCRIPTION

In the following detailed description, reference is made to specific examples by way of drawings and illustrations. These examples are described in sufficient detail to enable those skilled in the art to practice the inventive subject matter, and serve to illustrate how the inventive subject matter may be applied to various purposes or embodiments. Other embodiments are included within the inventive subject matter, as logical, mechanical, electrical, and other changes may be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. The following detailed description does not, therefore, limit embodiments of the invention, which are defined only by the appended claims.

Example Operating Environment

Figure 1:
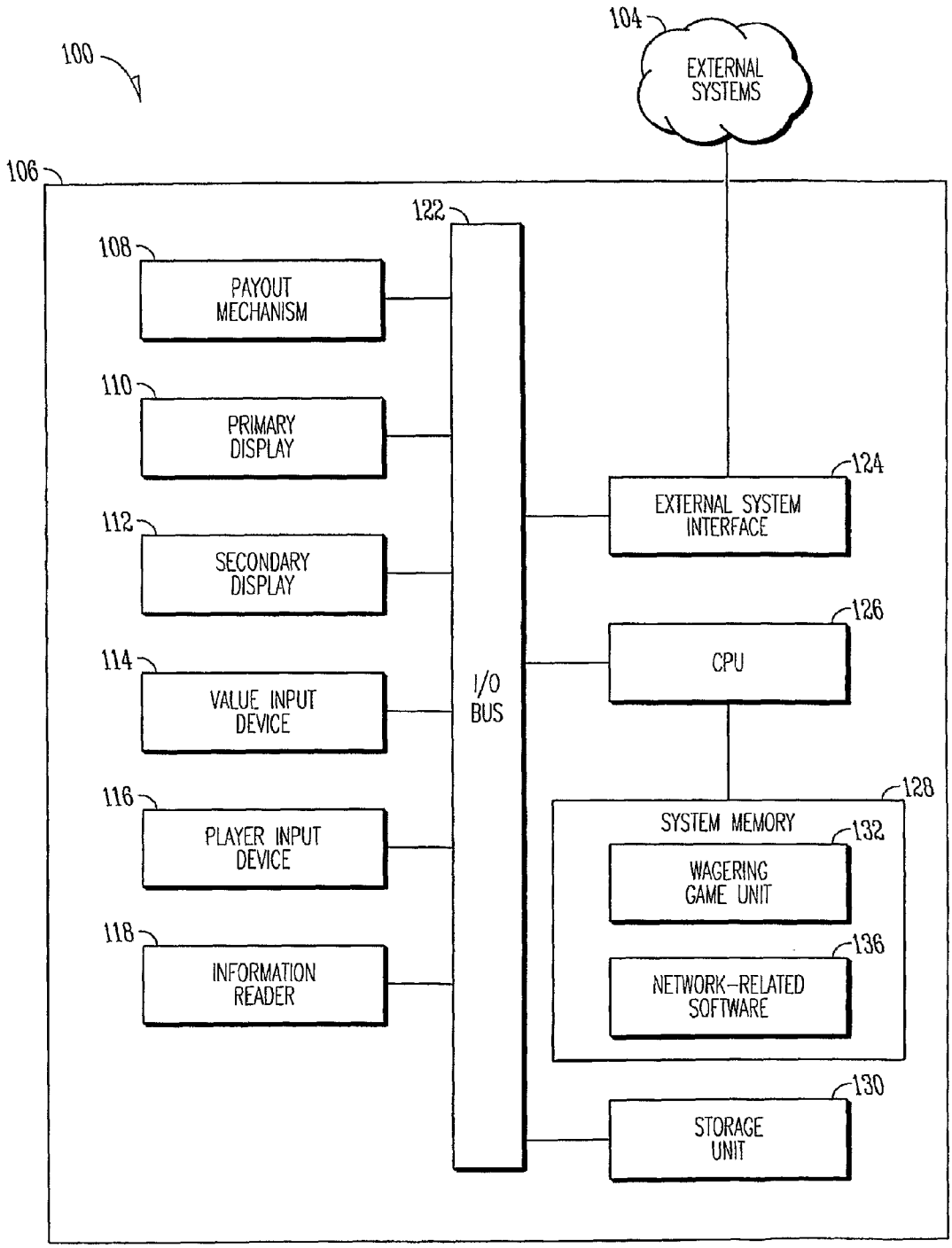
FIG. 1 is a block diagram of a control system suitable for managing a wagering game machine.

FIG. 1 is a block diagram illustrating a wagering game machine 106, according to example embodiments of the invention. As shown in FIG. 1, the wagering game machine 106 includes a central processing unit (CPU) 126 connected to a memory unit 128, which includes a wagering game unit 132 and network-related software unit 136. In one embodiment, the wagering game unit 132 can receive wagers and conduct wagering games, such as video poker, video blackjack, video slots, video lottery, etc. In one embodiment, the network-related software unit 136 performs various network-related tasks, as described herein. As illustrated in FIG. 1, network-related software unit 136 may be implemented in software residing in memory 128. However, in alternative embodiments, network-related software unit 136 may be implemented in firmware or hardware and connected to I/O bus 122.

The CPU 126 is also connected to an input/output (I/O) bus 122, which facilitates communication between the wagering game machine's components. The I/O bus 122 is connected to a payout mechanism 108, primary display 110, secondary display 112, value input device 114, player input device 116, information reader 118, and storage unit 130. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1. For example, in one embodiment, the wagering game machine 106 can include external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 (e.g., the network-related software unit 136) can include hardware, firmware, and/or software for performing the operations described herein. Furthermore, any of the components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
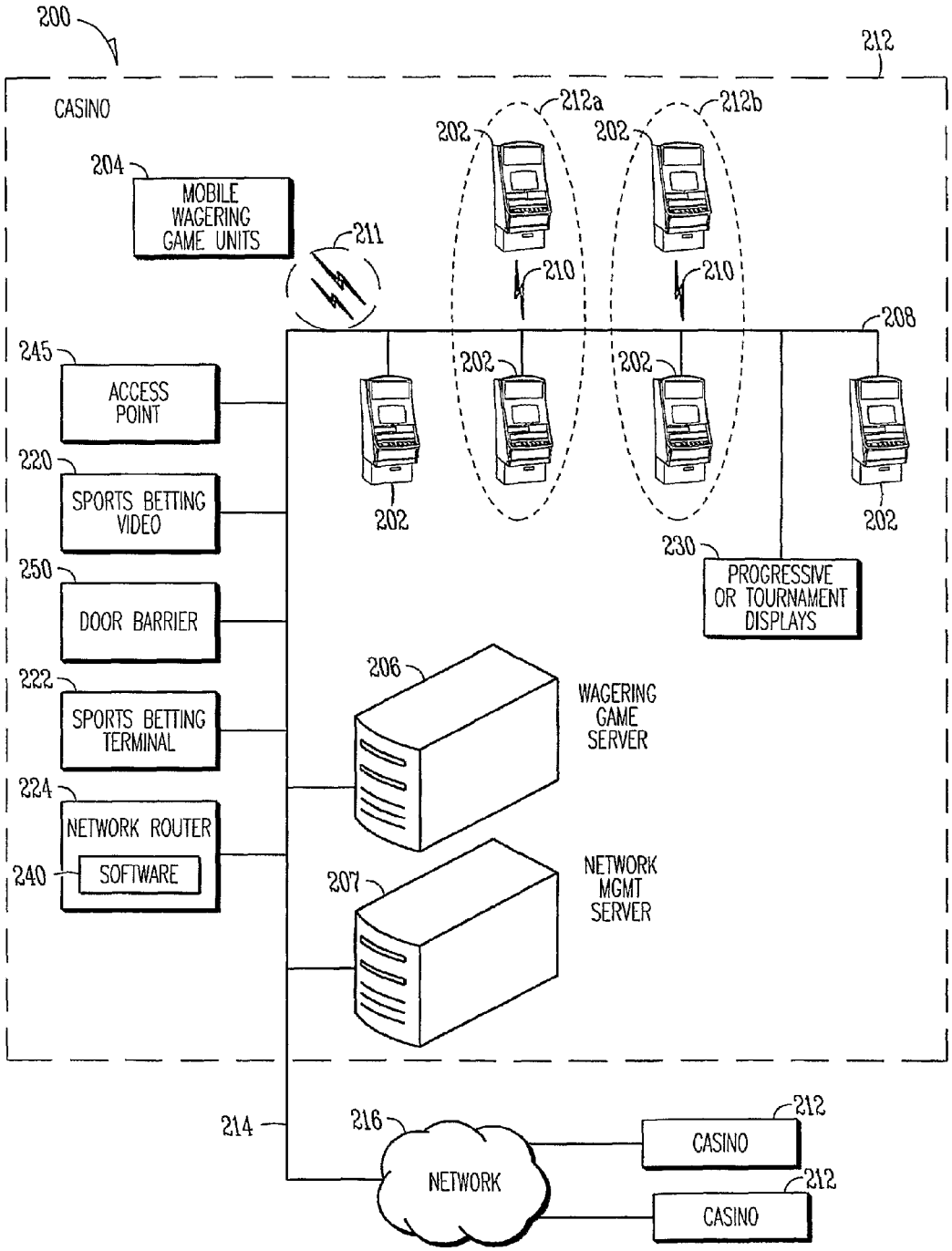
FIG. 2 is a block diagram of a network of wagering game machines and systems according to embodiments of the invention.

While FIG. 1 describes example embodiments of a wagering game machine, FIG. 2 shows how a plurality of wagering game machines can form a wagering game network. FIG. 2 is a block diagram illustrating a wagering game network 200, according to example embodiments of the invention. As shown in FIG. 2, the wagering game network 200 includes a plurality of casinos 212 connected to a communications network 216. Casinos 212 can have a casino floor area 212*a*, typically indoors, and adjacent or other areas 212*b*, such as the grounds of the casino, for instance the pool area or casino hotel rooms. Each of the plurality of casinos 212 includes a local area network 214, which connects wagering game machines 202 and mobile wagering game units 204 to a wagering game server 206, and connects local area network 214 to the communications network 216. The wagering game machines 202, mobile wagering game unit 204, and wagering game server 206 can include hardware and machine-readable media including instructions for doing various tasks, as described herein. In one embodiment, the wagering game server 206 can perform the various tasks in concert with serving wagering games over the local area network. According to another example embodiment, there is provided a network management server 207 that may be used to manage network resources and routing. In addition, the switches and network routing equipment 224 in the network 214 may also include intelligence that allows monitoring of network traffic and reroutes traffic dynamically according to load conditions. According to one example embodiment, a casino 212 may be a permanent physical structure or a temporary structure, such as a tent or temporary building, for example manufactured housing that may be assembled quickly and taken apart once it is no longer needed. For example, such temporary structures may be used to get a casino operation up and running quickly before a permanent structure has been completed, or as temporary quarters while repairs, renovations or additions are made to a permanent casino structure.

Figure 3:
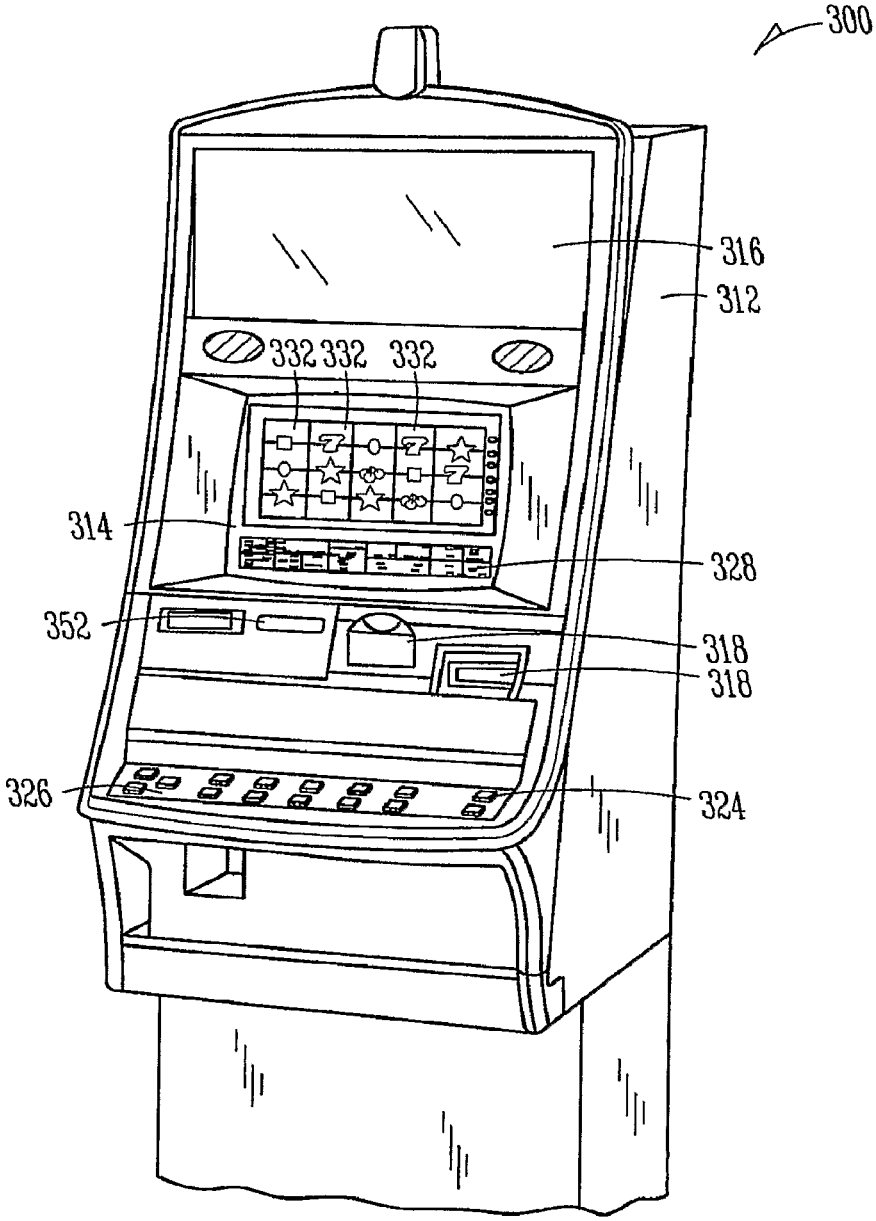
FIG. 3 is a perspective view of an example embodiment of a wagering game machine.

The wagering game machines described herein can take any suitable form, as described further in FIG. 3, such as floor standing models, handheld mobile units, bar-top models, workstation-type console models, etc. In addition, the gaming units 202 or 204 may also be computers owned by the patrons or provided to the patron for use in the casino, such as a laptop, tablet or hand-held computer, such as a personal digital assistant (PDA). Further, the gaming unit 204 may constitute a mobile telephone capable of executing a gaming application or serving as a client in a web-type application using Java, Flash, .NET, HTML, XML or other technologies with similar or greater capabilities. In one embodiment, the wagering game network 200 can include other network devices, such as accounting servers, wide area progressive servers, and/or other devices suitable for use in connection with embodiments of the invention. Further, the casino 212 may also include sports betting facilities for example with video displays 220 and sports betting terminals 222 that may be self-serve or operated by casino personnel. In addition, the casino may include progressive or tournament game displays 230, which may be used to display the pot for a progressive game, for example one conducted in association with a plurality of gaming units 202 or 204, or the pot for a tournament conducted using various gaming units 202 or 204.

FIG. 3 is a perspective view of a wagering game machine, according to example embodiments of the invention. Referring to FIG. 3, a wagering game machine 300 is used in gaming establishments, such as casinos. According to embodiments, the wagering game machine 300 can be any type of wagering game machine and can have varying structures and methods of operation. For example, the wagering game machine 300 can be an electromechanical wagering game machine configured to play mechanical slots, or it can be an electronic wagering game machine configured to play video casino games, such as blackjack, slots, keno, poker, blackjack, roulette, etc.

The wagering game machine 300 comprises a housing 312 and includes input devices, including value input devices 318 and a player input device 324. For output, the wagering game machine 300 includes a primary display 314 for displaying information about a basic wagering game. The primary display 314 can also display information about a bonus wagering game and a progressive wagering game. The wagering game machine 300 also includes a secondary display 316 for displaying wagering game events, wagering game outcomes, and/or signage information. While some components of the wagering game machine 300 are described herein, numerous other elements can exist and can be used in any number or combination to create varying forms of the wagering game machine 300.

The value input devices 318 can take any suitable form and can be located on the front of the housing 312. The value input devices 318 receive currency and/or credits inserted by a player. The value input devices 318 can include coin acceptors for receiving coin currency and bill acceptors for receiving paper currency. Furthermore, the value input devices 318 can include ticket readers or barcode scanners for reading information stored on vouchers, cards, or other tangible portable storage devices. The vouchers or cards can authorize access to a central account, which can transfer money to the wagering game machine 300.

The player input device 324 comprises a plurality of push buttons on a button panel 326 for operating the wagering game machine 300. In addition, or alternatively, the player input device 324 can comprise a touch screen 328 mounted over the primary display 314 and/or secondary display 316. The touch screen 328 can contain soft touch keys denoted by graphics on the underlying primary display 314 and used to operate the wagering game machine 300. The touch screen 328 provides players with an alternative method of input. A player enables a desired function either by touching the touch screen 328 at an appropriate touch key or by pressing an appropriate push button. Touch keys can be used to implement the same functions as push buttons. Alternatively, the push buttons can provide inputs for one aspect of operation, while the touch keys can allow for input needed for another aspect of operation.

The various components of the wagering game machine 300 can be connected directly to, or contained within, the housing 312. Alternatively, some of the wagering game machine's components can be located outside of the housing 312, while being communicatively coupled with the wagering game machine 300 using any suitable wired or wireless communication technology.

The operation of the basic wagering game can be displayed to the player on the primary display 314. The primary display 314 can also display the bonus game associated with the basic wagering game. The primary display 314 can include a cathode ray tube (CRT), a high resolution liquid crystal display (LCD), a plasma display, light emitting diodes (LEDs), an organic light-emitting diode (OLED) display, or any other type of display suitable for use in the wagering game machine 300. Alternatively, the primary display 314 can include a number of mechanical reels to display the outcome in visual association with at least one payline 332. In FIG. 3, the wagering game machine 300 is an "upright" version in which the primary display 314 is oriented vertically relative to the player. Alternatively, the wagering game machine can be a "slant-top" version in which the primary display 314 is slanted at about a thirty-degree angle toward the player of the wagering game machine 300. In yet another embodiment, the wagering game machine 300 can be a bartop model, a mobile handheld model, or a workstation console model.

A player begins playing the basic wagering game by making a wager via the value input device 318. A player can select play by using the player input device's buttons or touch screen 328. The basic game can consist of a plurality of symbols arranged in an array, and can include at least one payline 332 that indicates one or more outcomes of the basic game. Such outcomes can be randomly selected in response to the wagering input by the player. At least one of the outcomes can be a start-bonus outcome, which can include any variation of symbols or symbol combinations triggering a bonus game.

In some embodiments, the wagering game machine 300 can also include an information reader 352 used for identifying players by reading cards indicating players' identities. The information reader 352 can include a card reader or any suitable device, including a ticket reader, bar code scanner, RFID transceiver, or computer readable storage medium interface. In some embodiments, the information reader 352 can be used to award complimentary services, restore game assets, track player habits, etc.

Referring back to FIG. 2, the components of each casino 212 can communicate overwired 208 and/or wireless connections 210. Furthermore, they can employ any suitable connection technology, such as Bluetooth, 802.11, Ethernet, Coaxial, HFC cable, public switched telephone networks, SONET, etc. According to one example embodiment, the network 214 may be a mesh network topology, a star topology, a bus topology, a ring topology or a tree topology. Further, the network may be hard-wired or wireless. The wireless network may be a mesh network, or it may be formed of one or more access points off of a fixed backbone. According to another example embodiment, a variety of different network cabling/connection schemes and protocols may be employed for communications on the network, for example but not limited to Ethernet (based on Carrier Sense Multiple Access with Collision Detection), LocalTalk (based on Carrier Sense Multiple Access with Collision Avoidance), Token Ring, Fiber Distributed Data Interface (FDDI) or asynchronous transfer mode (ATM). Other protocols for use in communication on the networks 214 and 216, and the Internet, include Internet Protocol (IP), Transmission Control Protocol (TCP), Stream Control Transmission Protocol (SCTP), User Datagram Protocol (UDP), HyperText Transfer Protocol (HTTP), File Transfer Protocol (FTP), Internet Protocol version 6 (IPv6), Point-to-Point Protocol (PPP) or Point-to-Point Protocol over Ethernet (PPPoE) and other protocols.

According to one example embodiment, the wireless communication is provided using the IEEE 802.11 standard, known as the Wi-Fi standard, denotes a set of wireless LAN/WLAN standards developed by working group 11 of the IEEE LAN/MAN Standards Committee. The term is also used to refer to the original 802.11, which is now sometimes called "802.11 legacy." According to another embodiment, the 802.11g Wi-Max standard protocol may be used, or a proprietary wireless communication protocol.

Referring again to FIG. 2, the local area network 214 includes a plurality of network paths 214 between servers 206 and wagering game units 202 and 204, through a plurality of network nodes (e.g., sports betting terminals 222), which may include network routing equipment 224, such as at least one router, switch, hub or software component, wherein some of the network paths 214 may be the wired paths 208 and some may be the wireless paths 210 providing wireless network operation. Also provided are a plurality of wireless access points 245, wherein the access points 245, which may also include network routing equipment 224, are positioned around the casino 212 so as to provide full coverage of the casino floor 212*a* or adjacent spaces 212*b* such as the casino grounds or associated hotel rooms and common areas. Further, according to one example embodiment, network 214 is configured and adapted to accommodate roaming, for example implemented through routing software 240 operable, for example, on one or more of the network routing equipment 224 distributed throughout network 214. According to one embodiment, the routing software 240 enables a mobile gaming unit 204 to roam around the casino and switch wireless access points 245 seamlessly with no perceptible drop in connection to the user of the device. According to still another example embodiment, there may be provided an electronic door barrier 250, for example but not necessarily controlled from a central network resource such as gaming server 206, that disables the mobile gaming device 204 when it goes out the door or other perimeter set up for the casino. Further, according to still another example embodiment, the wireless paths 210 may be configured to provide one or more wireless channels 211 used to communicate with gaming units 204.

Figure 4:
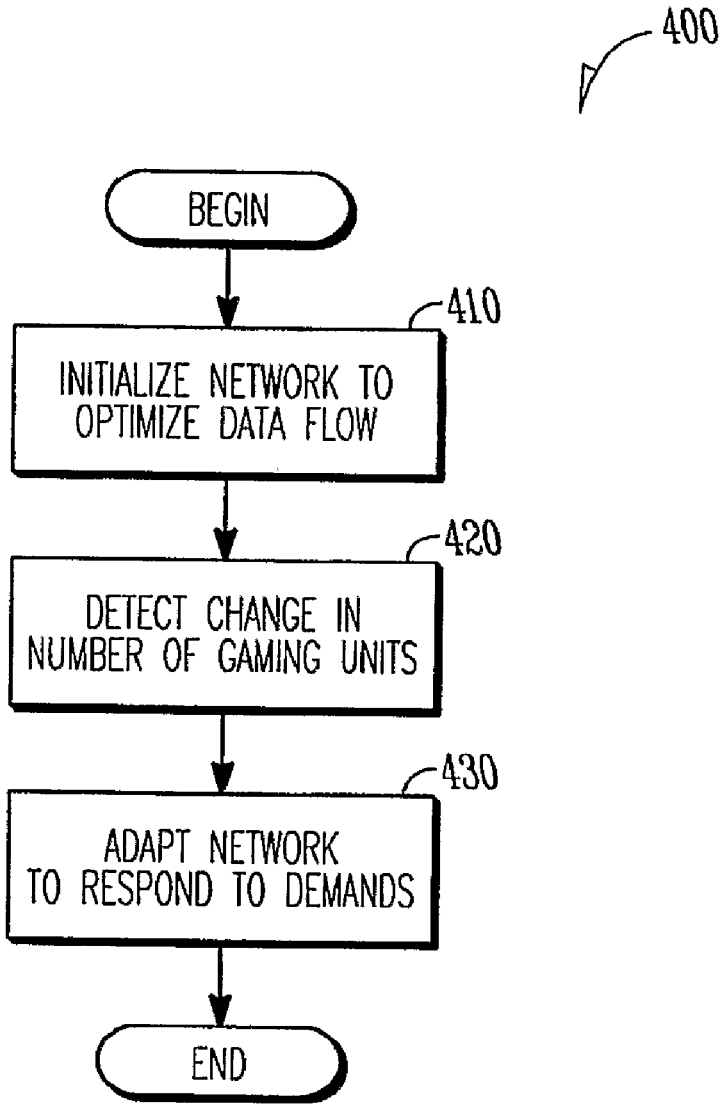
FIG. 4 is a flowchart illustrating a method according to one example embodiment of the inventive subject matter.

According to one example embodiment 400 of a method illustrated in FIG. 4, networks 214 and 216 are set up and initialized 410 to optimize the flow of data between gaming units 202, 204, game servers 206, network elements such as network routing equipment 224 or switches, wireless or wired, or other systems or networks. In one example embodiment, the number of gaming units 202 or 204 deployed from any point of the network may change 420 from time to time, or constantly, for example in the case of portable or mobile gaming units 204 moving around the casino floor or casino grounds. Thus, according to one example embodiment of the inventive subject matter, networks 214 or 216 are adapted 430 to dynamically respond to randomly fluctuating demands and failures by dynamically rerouting network traffic and by reallocating resources. In one example embodiment rerouting network traffic is done in a decentralized fashion, and in another embodiment in a centralized fashion. Such rerouting may take place under the local or distributed control of one or more network routing equipment 224, through a centralized control from a single one of network routing equipment 224, or a combination of centralized and distributed control.

Figure 5A:
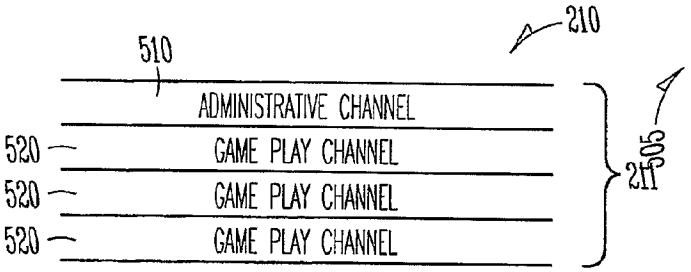
FIGS. 5A-5C are illustrations of a wireless path and networked systems according to example embodiments of the inventive subject matter.

According to still another example embodiment illustrated in diagrammatic form in FIG. 5A, the wireless paths 210 may be configured to provide one or more wireless channels 211 dedicated to be used to communicate with gaming units 202 or 204 for administrative purposes 510, such as downloading new game software or data, and one or more channels for data used to support game play 520 in real time or near real time. The quality of service provided for the game play channels may be much higher than the quality of service afforded administrative tasks that do not require real time data delivery. Thus, in general, different channels may be used for different purposes, such as different channels for game play and administration as noted. According to still another example embodiment, one channel may be secure and another channel may not be secure, to support play or administration in same game or in the gaming network. According to another embodiment, the network 214 may be configured with dedicated radios and channels that provide point to point communication between network routing equipment 224, switches and wireless access points 245 in the network, to provide an Ethernet-like backbone configuration. According to one example embodiment, a multiple-in-multiple-out (MIMO) wireless chip set may be used for this purpose.

Figure 5B:
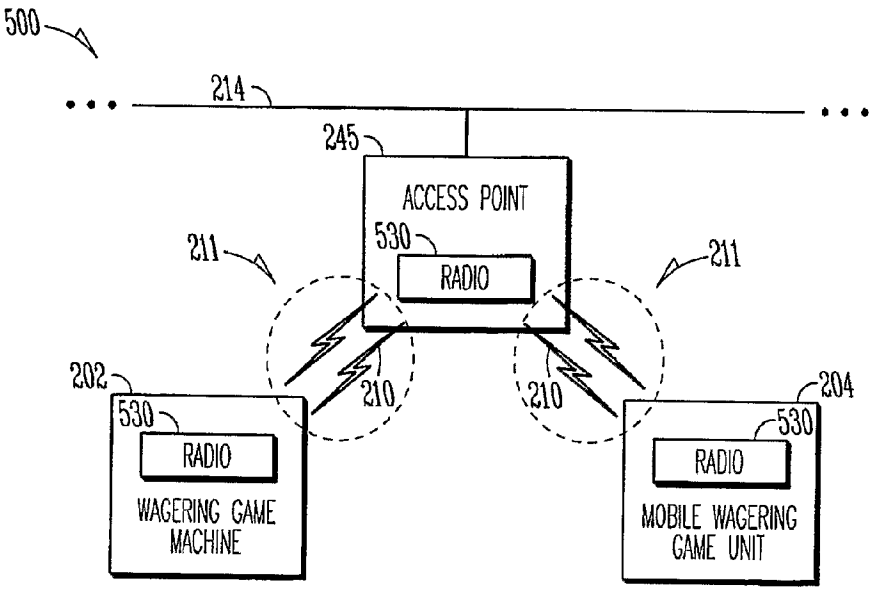
Figure 5C:
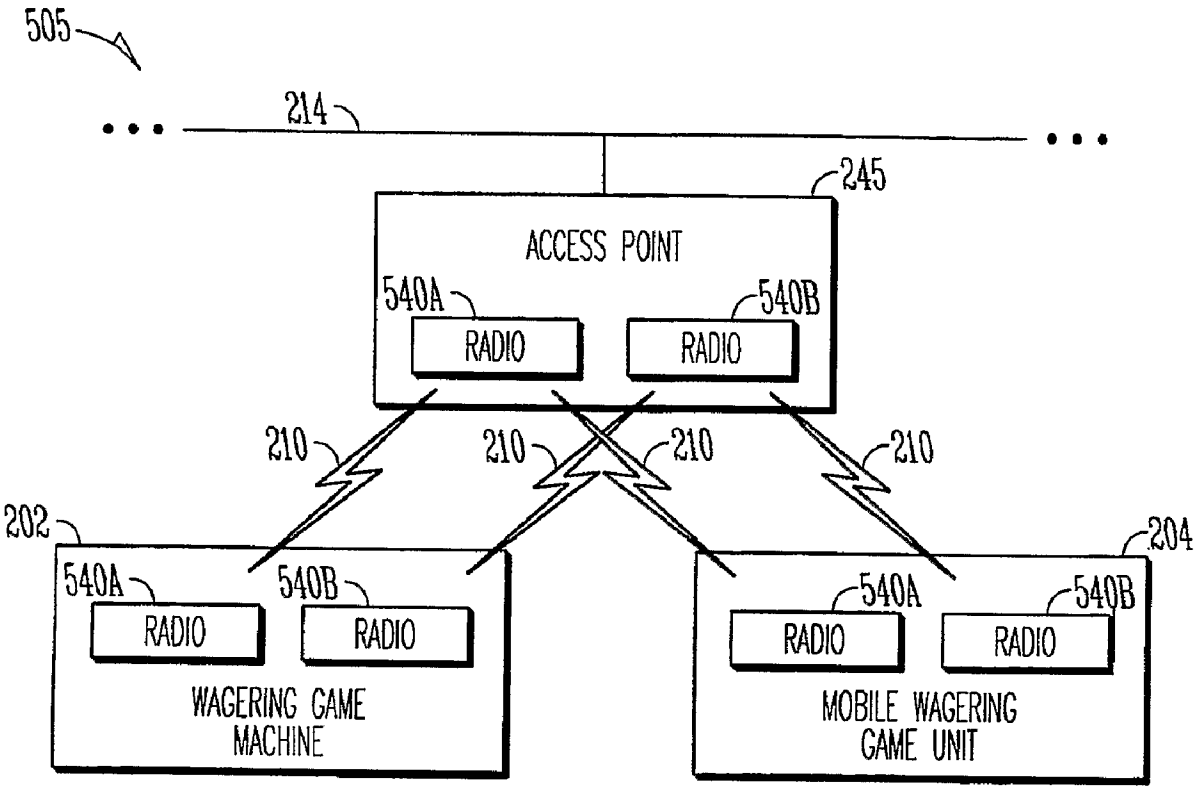

In addition, according to another example embodiment 500 illustrated in FIG. 5B, a gaming unit 202 or 204 or wireless access point 245 may use the same radio 530 to provide different channels 211. According to another example embodiment 505 illustrated in FIG. 5C, there may be multiple radios 540A, 540B per gaming unit 202 or 204 or other network component in the casino, with each radio 540A, 540B supporting separate channels.

Figure 6:
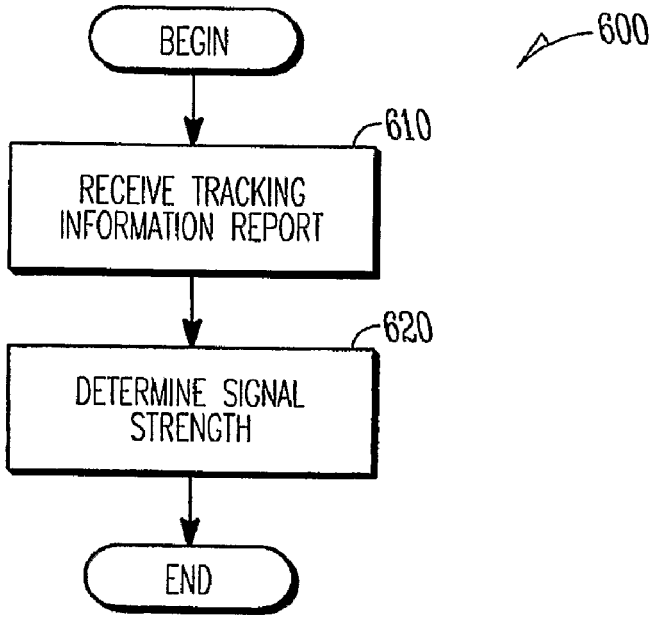
FIGS. 6-9 are methods according to example embodiments of the inventive subject matter.

Referring now to FIG. 6, in order for example to determine network traffic demands or to track the location of players, in one example embodiment 600 there is provided methods and systems for tracking the location of wireless mobile gaming units 204, or at least the wireless access point 245 through which the gaming units 204 are communicating with the network 214. Such tracking may be performed by having wireless access points 245 report 610 to the network management server 207. Such reporting may include 620 the strength of the signal received from the mobile gaming unit 204. The network management server 207 may then use information concerning the strength of the signal received at this or other access points 245 in order to determine the location of the gaming unit 204. According to one embodiment, there is provided a visual interface that displays, for example, the position of individual gaming units 202 or 204 in the network 214, for example dynamically to show movement of such devices in a wireless environment. Such visual display may allow the casino to locate individual players in case they wish to communicate with them.

Figure 7:
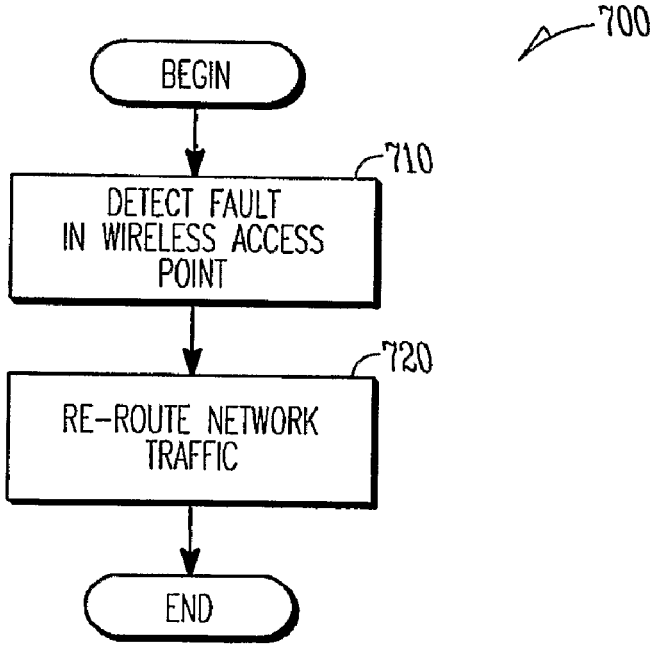

Referring now to FIG. 7, in another embodiment 700, the network 214 is adapted to monitor its wireless coverage, for example by detecting 710 faults in a wireless access point 245, and in the event that there is a disruption of service from one access point 245, dynamically re-routing 720 network traffic to balance traffic and prevent an overload condition in a branch or leg of the network 214 that picks up the load for the faulting access point 245. For example, traffic may be rerouted for any particular gaming unit 202 or 204 to provide for the shortest path from server to game. According to another embodiment, if a mesh network topology is used, traffic may be rerouted on the network due to the removal, failure or overload of a node on the mesh network.

For this purpose, the network management server 207 may monitor both network coverage in terms of wireless coverage from each access point 245, and also network traffic conditions. According to one example embodiment, the network 214 is self healing such that if one access points 245 drops out, others are reconfigured under the control of the network routing equipment 224 or the network management server 207, for example by increasing RF transmission power from the wireless access points 245, and optionally the sensitivity of the receivers in the access point 245, to communicate with the mobile units 204, to allow them to more effectively take up the load.

Figure 8:
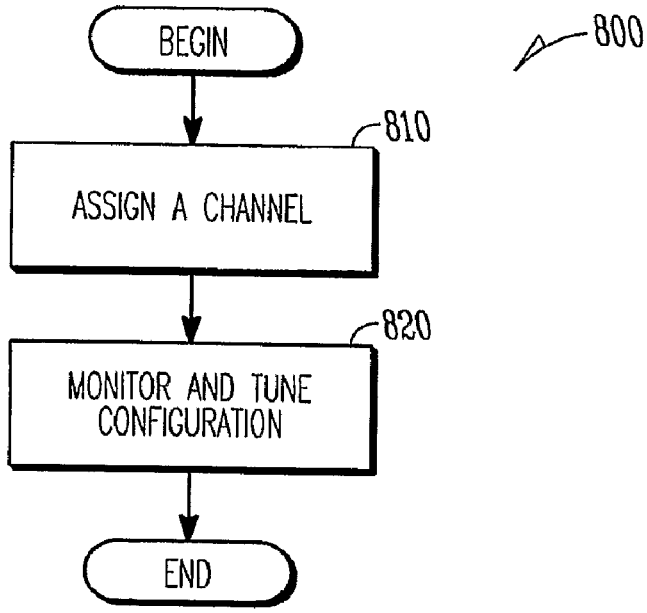
Figure 9:
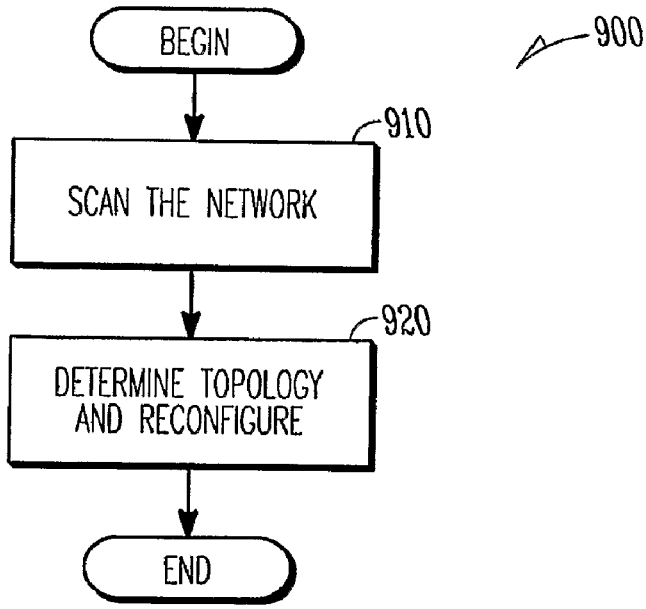

According to still another example embodiment 800 illustrated in FIG. 8, there is provided a system and method for automating the installation of the wireless network. Such automation includes an example embodiment of a system and method where the assignment of channels in the wireless access point equipment (for example Wi-Fi compatible equipment) is automated 810 to minimize interference between channels, and so that the time of technicians required for this purpose is minimized. According to another embodiment, the system provides for automated monitoring and tuning 820 of the wireless configuration to minimize or eliminate dead spots, for example due to interference or poor coverage, or overload. In addition, as shown in the example embodiment 900 of FIG. 9, the system and method may scan 910 the network 214 and use the scanning results to determine 920 its topology to aid in automatic configuration and reconfiguration. For this purpose, in one example embodiment, a mobile device may be moved around the floor or other casino area to determine signal strength and to map out the coverage on the floor or other area. In addition, mobile gaming units 202 or 204 can be adapted to include the capability to report back to the network management server 207 their signal strength at all times, allowing the network 214 to determine approximately which areas are weak in signal strength using triangulation techniques.

Figure 10:
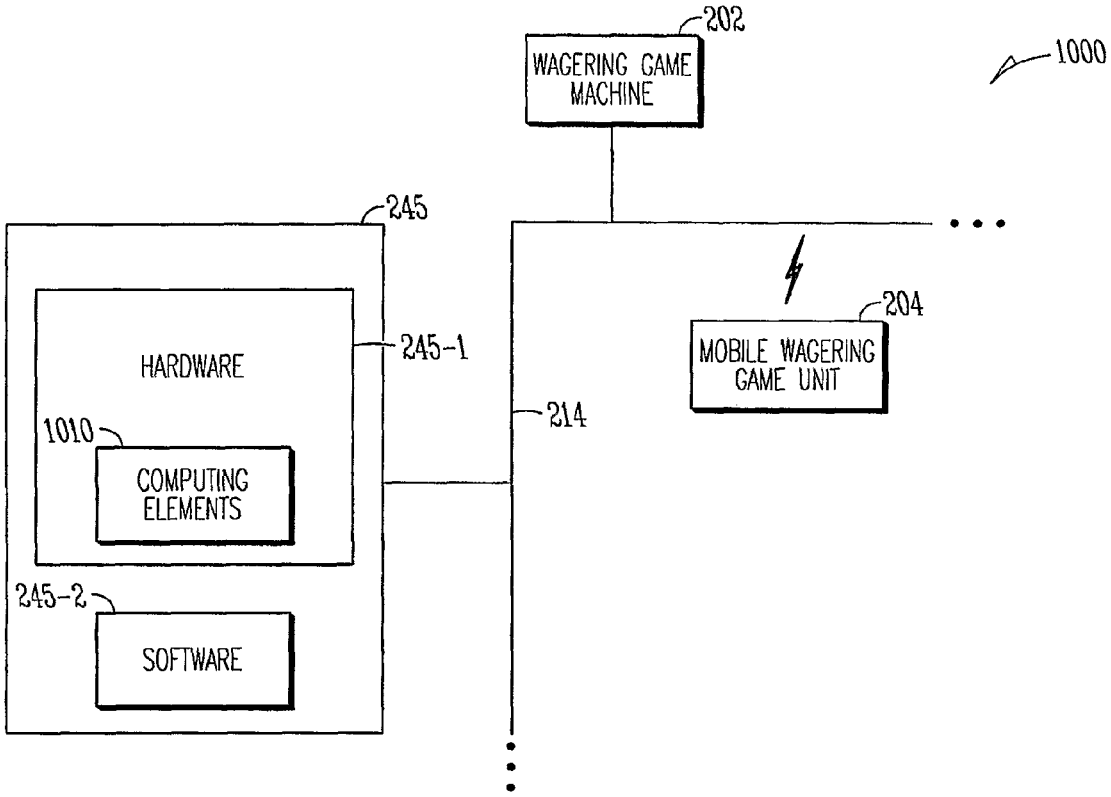
FIGS. 10 and 11 are diagrams illustrating networked systems according to example embodiments of the inventive subject matter.

According to another example embodiment 1000 illustrated in FIG. 10, the access points 245 are each adapted to be intelligent so that they can tell which devices they are allowed to listen to or not, in order to prevent a hijacking of the network 214 or unnecessary interference from devices that are not allowed access to the network 214. Further, the example embodiment may provide for portable/mobile gaming fraud detection, by detecting rogue access points 245 or attempts and sounding alarms, or detecting spoofs, or determining if a gaming device 202 or 204 has been hijacked. Such intelligence and fraud protection may be provided with one or more hardware components 245-1 and/or one or more software components 245-2. Hardware components 245-1 may include programmable devices such as a computer, hardwired or permanently programmed circuits, or fire-wall components that are resistant to viruses and attacks or unauthorized intrusions. Software components 245-2 may include one or more software components active to provide firewall, authentication, verification or monitoring functions, for example executing on computing elements 1010 included in the hardware components 245-1. In another embodiment, an intelligent access point communicates with the network management server 207 in order to report status and provide intelligent management functions, such as but not limited to shutting down when an unauthorized access is detected or redirecting network traffic in the even of a failure.

Figure 11:
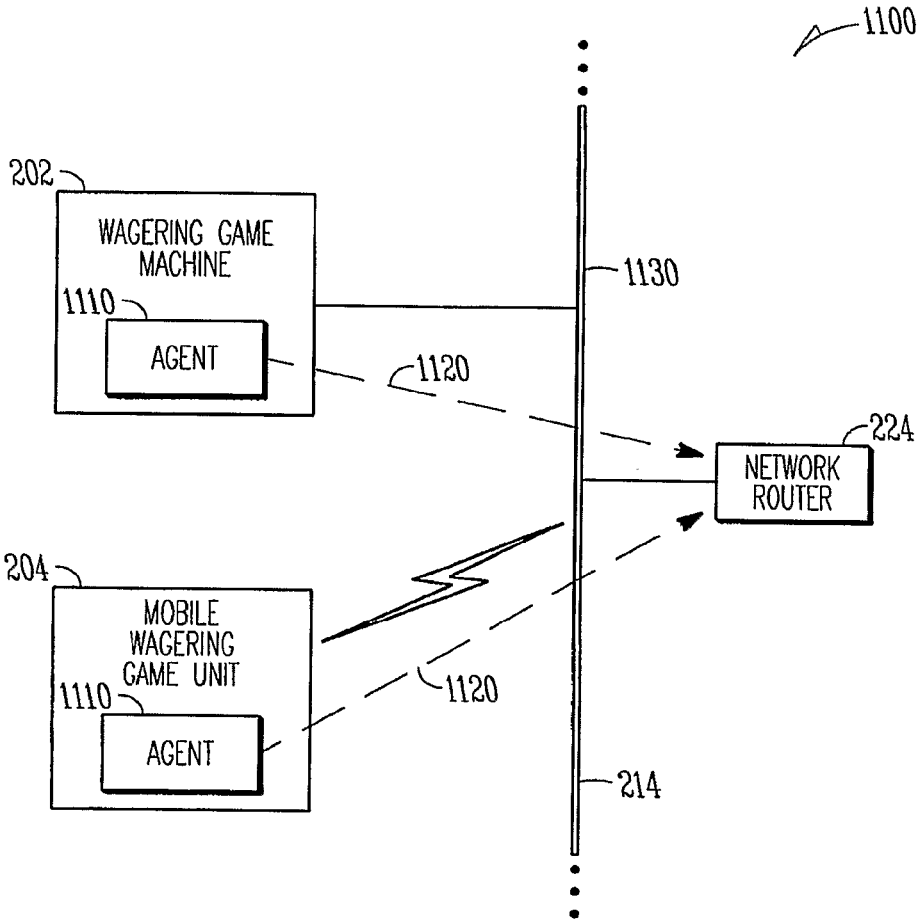

According to one example embodiment 1100 illustrated diagrammatically in FIG. 11, each of the gaming units 202 or 204, or other network elements or routing or switching devices may include agents 1110 that bid 1120 for bandwidth 1130 against other agents 1110, based on a characteristic of the traffic they need to transfer. One such characteristic may be the importance or priority of the traffic. Such bids may be provided to a device in a network node, such as network routing equipment 224, or in an alternate embodiment, bids are placed with the network management sever 207 (FIG. 2), which manages the bids.

Figure 12:
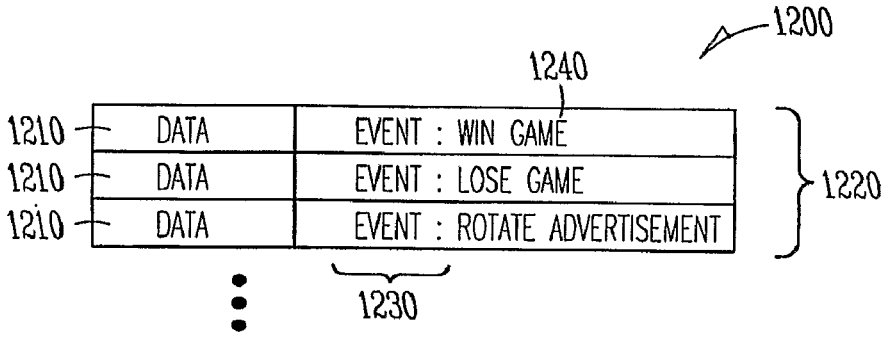
FIG. 12 is an illustration of network prioritization according to one example embodiment of the inventive subject matter.

In an embodiment, intelligent switches and network routing equipment 224 in the network 214 monitor network traffic and route traffic based on priority. According to another embodiment 1200 diagrammatically illustrated in FIG. 12, messages or data traffic 1210 may be prioritized 1220 through the network routing equipment 224, based on the priority of the message or traffic. That priority may be set, for example based on the type of event 1230 that is supported with the traffic, such as the type of information 1240 conveyed relating to game play. For example, traffic or messages relating to game outcome or game determination may have higher priority over traffic containing non-essential video content for use in a video display of a slot machine, progressive or sports betting audiovisual display, usage of the network 214 is optimized based on dynamically re-routing based on usage, for example if there is a large download planned or about to be executed, (large meaning relative to network traffic) preemptive load balancing is performed to adapt the quality of service (QOS) levels to ensure a high level of service for important applications. According to another example embodiment, wide area progressives (WAP) messages are content prioritized. Other content prioritization may include, for example, giving low priority for downloads, and higher priority for server-based games as opposed to monitoring traffic. According to another example embodiment, data traffic is prioritized based on player perception.

Figure 13:
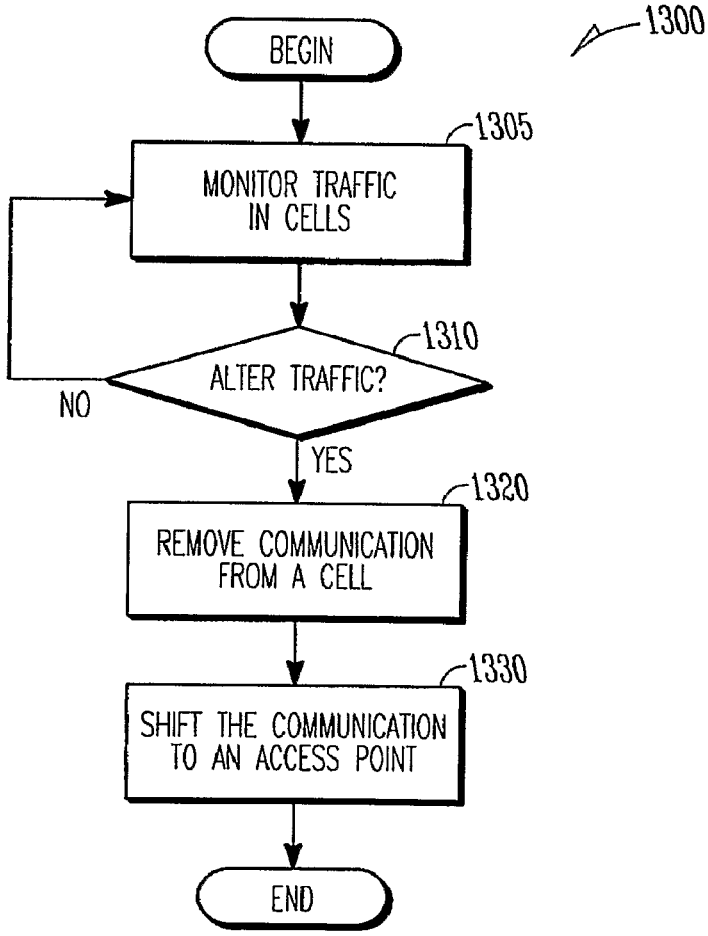
FIG. 13 is a flowchart illustrating a method according to one example embodiment of the inventive subject matter.

In an embodiment, intelligent switches and network routing equipment 224 in the network 214 monitor network traffic and reroutes traffic dynamically. Referring now to FIG. 13 there is illustrated another embodiment 1300 for routing data traffic in network 214. Traffic is monitored 1305 and may be altered 1310 in a wireless network 214 by removing some communication 1320 from a cell and shifting it to another access point 1330. For example, the system and method may clear out a cell in order to perform a download of software or support tournament traffic.

Figure 14:
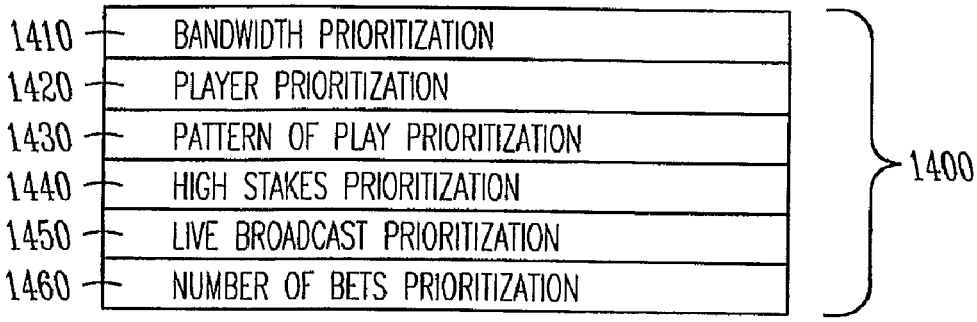
FIG. 14 is an illustration of network prioritization according to one example embodiment of the inventive subject matter.

Referring now to FIG. 14, there is illustrated a plurality of prioritization methods 1400 according to an example embodiment, wherein content for the display on a gaming unit 202 or 204 may be selected based on available bandwidth 1410, for example a richer, denser video stream with a higher bit rate may be sent and displayed on the gaming unit 202 or 204 when bandwidth is plentiful, and a more compressed, lower bit rate or lower quality of content or alternative content that requires less bandwidth may be sent and displayed when bandwidth is scarce. In another approach, network traffic may be allocated based on the identity of the player 1420 playing a gaming unit 202 or 204, or based on player characteristics such as recent pattern of play 1430, for example assigning higher priority to data or messages serving a "high roller" player or other type of preferred player such as a valued customer. According to another embodiment, gaming units 202 or 204 that are higher stakes machines, such as a dollar slot vs. a nickel slot, get priority 1440 over lower stake machines. In another embodiment, for example, the live broadcast of a sports event in the casino may get higher priority 1450 in the network 214 than other traffic, or the higher priority may be given to events with the most number of bets placed 1460 such that the greater quality display is provided to the most number of players.

Figure 15:
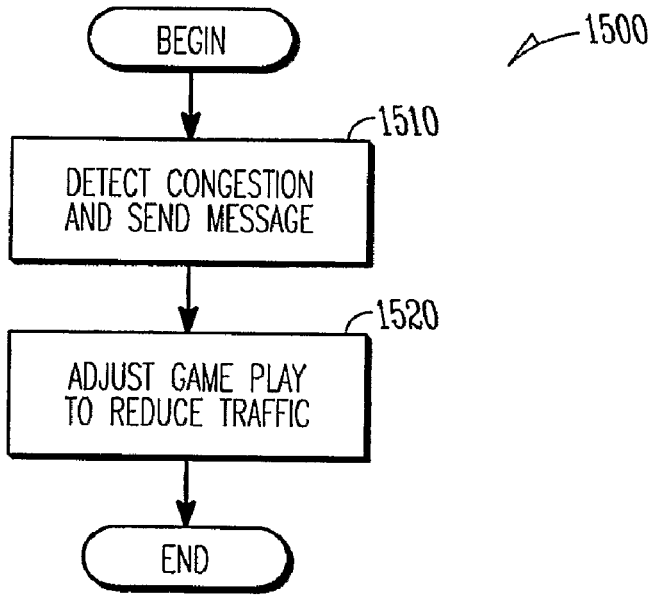
FIG. 15 is a flowchart illustrating a method according to one example embodiment of the inventive subject matter.

According to another example embodiment 1500 illustrated in FIG. 15, if network traffic becomes congested or overloaded, a message or instruction may be sent 1510 to gaming units 202 or 204, or other devices in the casino, instructing them to hold any further traffic for a short period of time, when an appropriate break point is reached. A game may hold or reduce traffic 1520 in any number of ways. For example, in between spins or plays of a game, the game may delay initiation of a spin sequence for a period of time largely imperceptible to the player but long enough to allow higher priority traffic to pass on the network 214.

Figure 16A:
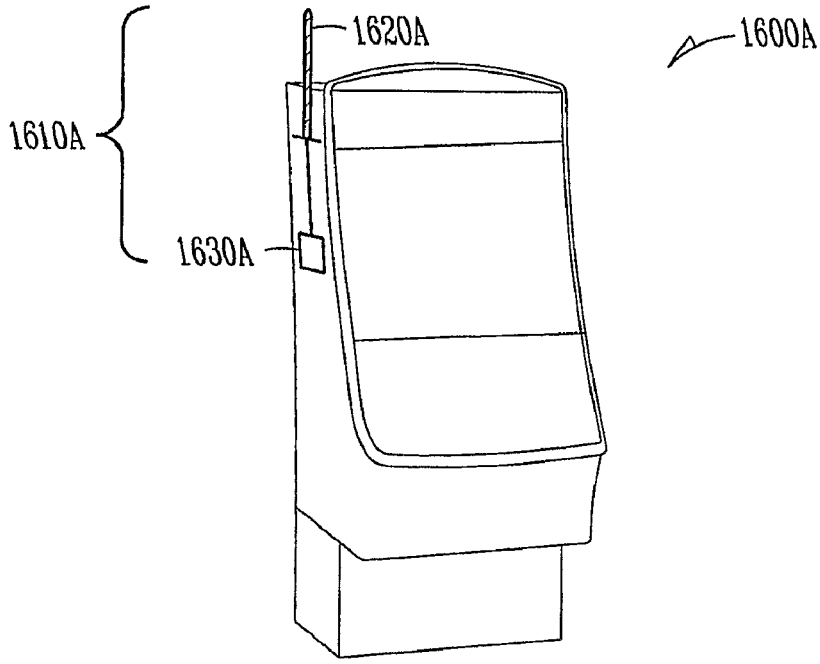
FIGS. 16A and 16B are illustrations of gaming machines according to example embodiments of the inventive subject matter.
Figure 16B:
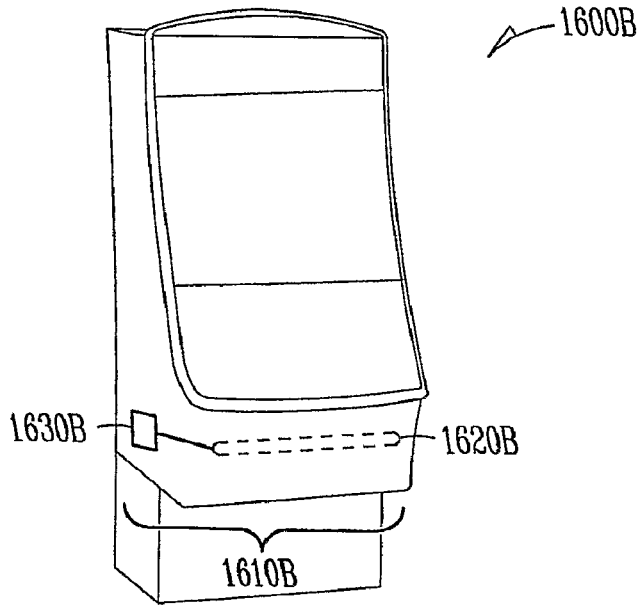

According to other example embodiments 1660A, 1600B illustrated in FIGS. 16A and 16B, there is provided a system and method wherein a wagering game machine 202 that is normally fixed or not portable, includes a wireless access point device 1610A built into or integrated with the wagering game machine 202, so that a plurality of such machines could be used to create a wireless network with wireless network coverage for mobile devices 204. Such wireless network may be formed as a wireless mesh, or as fixed network. For example, such wireless access point device 1610A may include an antenna 1620A exposed on the top or side of the unit 202, and network routing equipment 1630A, such as a router, switch or hub. All or part of the device 1610A may be deployed above the gaming device on a mast supported by the gaming units 202. Such an antenna 1620A may be deployed, for example, in a candle-shaped injection-molded antenna. In an alternative embodiment, the wireless access point device 1610B includes an antenna 1610B that may be deployed in front of a glass bezel on the belly or top of a gaming unit 202 and transmit and receive through the bezel.

Figure 17:
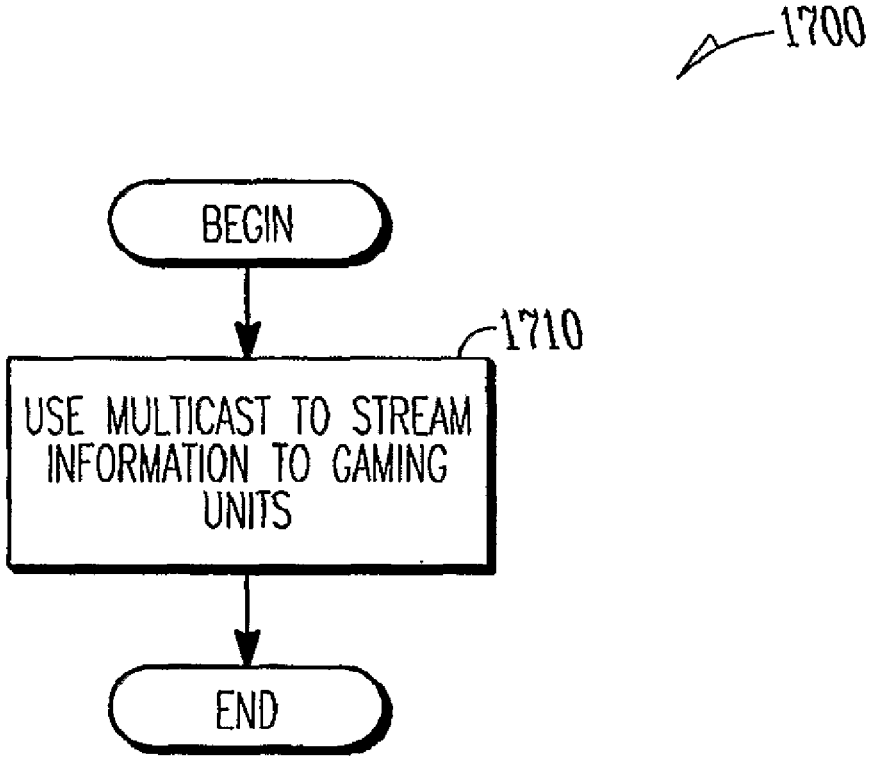
FIG. 17 is a flowchart illustrating a method according to one example embodiment of the inventive subject matter.

According to one example embodiment 1700 illustrated in FIG. 17, a multicast method may be used 1710 to stream out information to gaming units 202, 204 or other devices on the network 214. For example, in large events like tournaments with many players, it may be preferable to multicast data to all participants. In one embodiment, if a multicast of updates is provided on an Ethernet segment all machines on that segment see the update and are burdened potentially unnecessarily processing the traffic. In another embodiment, a multidrop is used, and only receivers of that drop get to see it, thereby reducing unnecessary traffic to clients that do not need the data. According to still another example embodiment, the network 214 is configured in a virtual LAN (VLAN) configuration which may provide for a limited broadcast wherein the data is propagated within the network 214 only as far as necessary. VLAN broadcasts will go on same subnet but not outside the subnet so that unnecessary traffic on the network 214 is minimized. Such VLAN may be deployed for the wired portion of the network or the wired and wireless portion both, and/or for a fixed backbone network or mesh network.

According to one method and system, a VLAN header is place on each packet in the network 214. By use of the VLAN configuration, traffic is reduced on the network 214 as a whole as it more precisely directed through the ports and switches on the network 214 to target devices. Further, some devices supported by the network 214 can be in the virtual LAN group and others not, so that the network 214 can support VLAN traffic and non-VLAN traffic. In the wireless portion of the network 214, however, all devices 204 may see the same traffic. In one embodiment, however, according to one example embodiment VLAN traffic on the wireless network may be blocked if the client to whom the traffic is addressed is not in the wireless path. According to another example the system and method provides for broadcast in UDP protocol over the VLAN, or the use of stream controlled transmission protocol (SCTP) which provides for information flowing between endpoints.

According to another example embodiment, in a VLAN network, switches are configured to automatically assign ports. According to still another example embodiment, the VLAN configuration is used to support a progressive gaming network, such that communication with the progressive server and the progressive displays minimize traffic on the network.

According to still another example embodiment, there is provided a progressive game network operating over a wired or wireless link. According to one embodiment, progressive game update messages are broadcast to clients with no requirement any individual client to subscribe. Alternatively, as indicated above, a VLAN can be provided to broadcast progressive game updates. According to one example embodiment, in an IP multicast, if the layer 2 Ethernet port is not properly set up, the multicast will end up being broadcast. On the other hand if, for example, the IP level broadcast is deployed on layer 2 and through a router in a VLAN, only clients on the virtual VLAN network see it, saving other clients from the traffic and preserving network capacity. According to another embodiment, subnet broadcasts are used to send to all desired destinations, but not others, to preserve and manage bandwidth.

According to another embodiment, a VLAN group may be set up such that a broadcast is sent once to the group. To assure that all devices or clients received the broadcast, members of the group may be required to send a negative response if they don't receive the broadcast. The client may know it has missed a broadcast by sequencing the broadcasts so that the client can determine if it missed a previous broadcast as it detects a broadcast out of sequence. According to another embodiment, when the information must be received reliably, for example it is required to determine game outcome, the system may use a reliable unicast messaging. According to another embodiment, a multicast may provide for managing joining a WAP or LAP and who is eligible to join and which to join.

Figure 18:
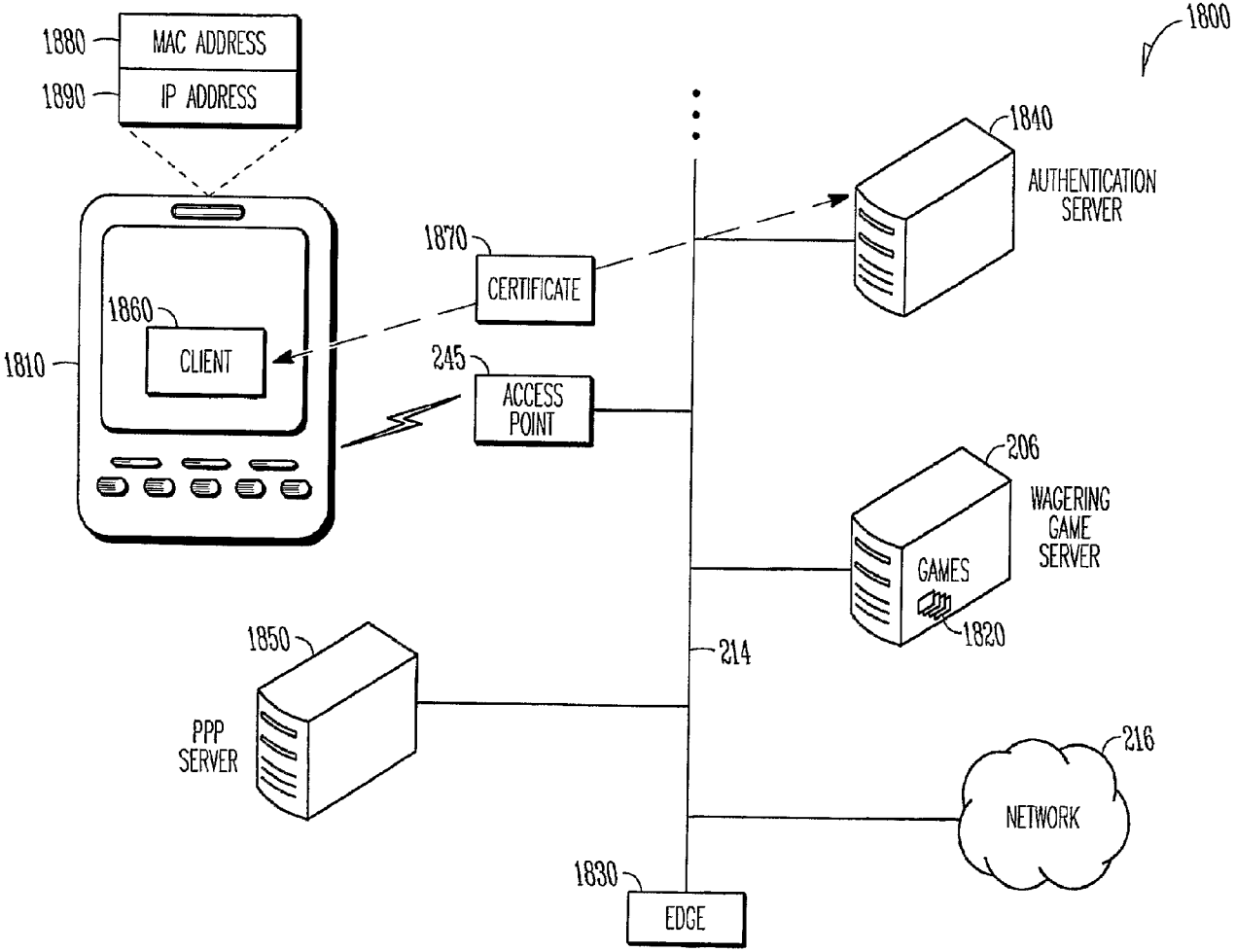
FIGS. 18-21 are diagrams illustrating networked systems according to example embodiments of the inventive subject matter.

According to another example embodiment 1800 of the systems and methods disclosed herein, as illustrated in FIG. 18, a player may bring his or her own mobile computing device 1810 to act as a mobile gaming unit 204 on the network 214. Mobile computing device 1810 may be, for example, a laptop, personal digital assistant (PDA), mobile telephone, or tablet computer. Mobile computing device 1810 can be connected to network 214 either by wired or wireless connection, in order to play casino games 1820 such as tournament poker, PC-based slots, or any other game that can be supported by the server 206 and the player owned mobile computing device 1810. According to one example embodiment, the mobile computing device 1810 may include a MAC address 1880 and the player computing device may be connected to the network through an Ethernet cable or a wireless connection. According to one embodiment, the MAC address 1880 is determined and an IP address 1890 is established to identify the player computing device to the network 214, for example to the edge 1830 of the network 214. In the case of a wireless connection, the player computing device may seek an access point 245, send a message to the access point 245, which in turn may contact, for example, an authentication server 1840, such as a Radius authentication server, to exchange credentials to validate the player computing device client into the network 214, and in turn if appropriate all the client into the network 214 or reject it. According to another example embodiment, a PPP or PPPoE server 1850 may be included to provide a tunnel PPP session into the network 214.

According to another example embodiment, there is provided system and method to verify that a proper software client 1860 on the player device 1810 is being used. Such functionality may be obtained by having the authentication server 1840 obtain a certificate 1870 from the software client 1860, in order to verify the authenticity of the client 1860. According to one embodiment, gaming applications are run as web applications and Digital Signature Algorithm (DSA) authentication is used on the client.

Figure 19:
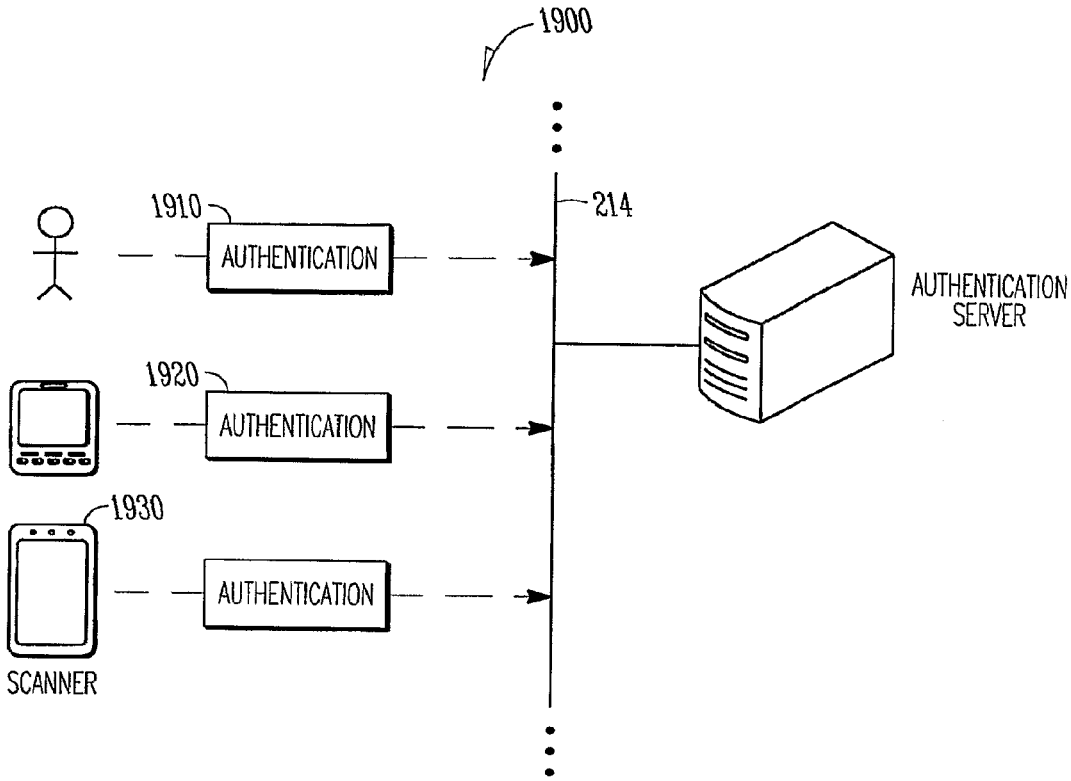
Figure 20:
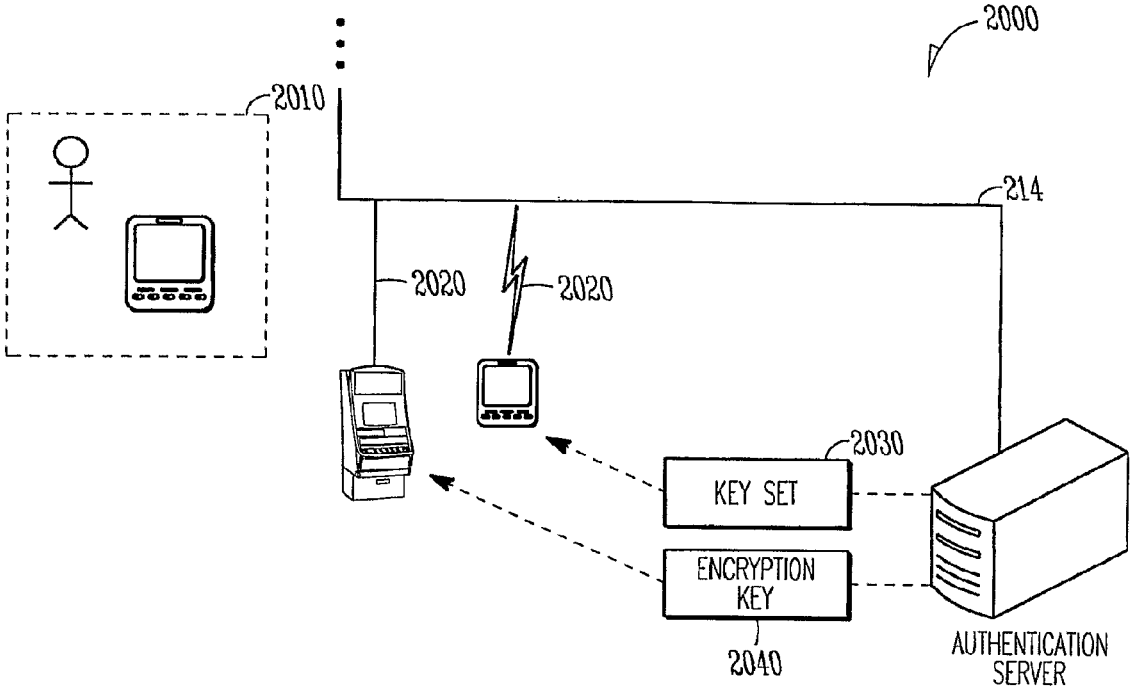

According to one example embodiment, the 802.1x standard is used for a wireless connection. According to one embodiment, a user is verified using the 802.1x protocol, and not the device. In another embodiment 1900 illustrated in FIG. 19, both user 1910 and device level 1920 authentication is provided, for example the device may be authenticated but also the player is identified, for example to prevent children or underage players from using an authenticated device that is not within the purview of casino personnel, for example in private room. According to one example embodiment also illustrated in FIG. 19, such authentication may be provided using biometric devices 1930, for example to check a fingerprint or retina According to another example embodiment 2000 illustrated in FIG. 20, there is provided methods and systems to make sure that players 2010 or devices 2010 can't sniff other players' data streams 2020 and use the information to cheat or steal data. In one embodiment, key sets 2030 may be generated and sent out to the computing devices. According to one example embodiment, wireless encryption keys 2040 are used to secure communications with the player computing device 1810 and are changed periodically. The authentication key 2030 may also change periodically, for example like a root certificate, wherein the keys may be rotated to assure that devices are not being sniffed or spoofed.

Figure 21:
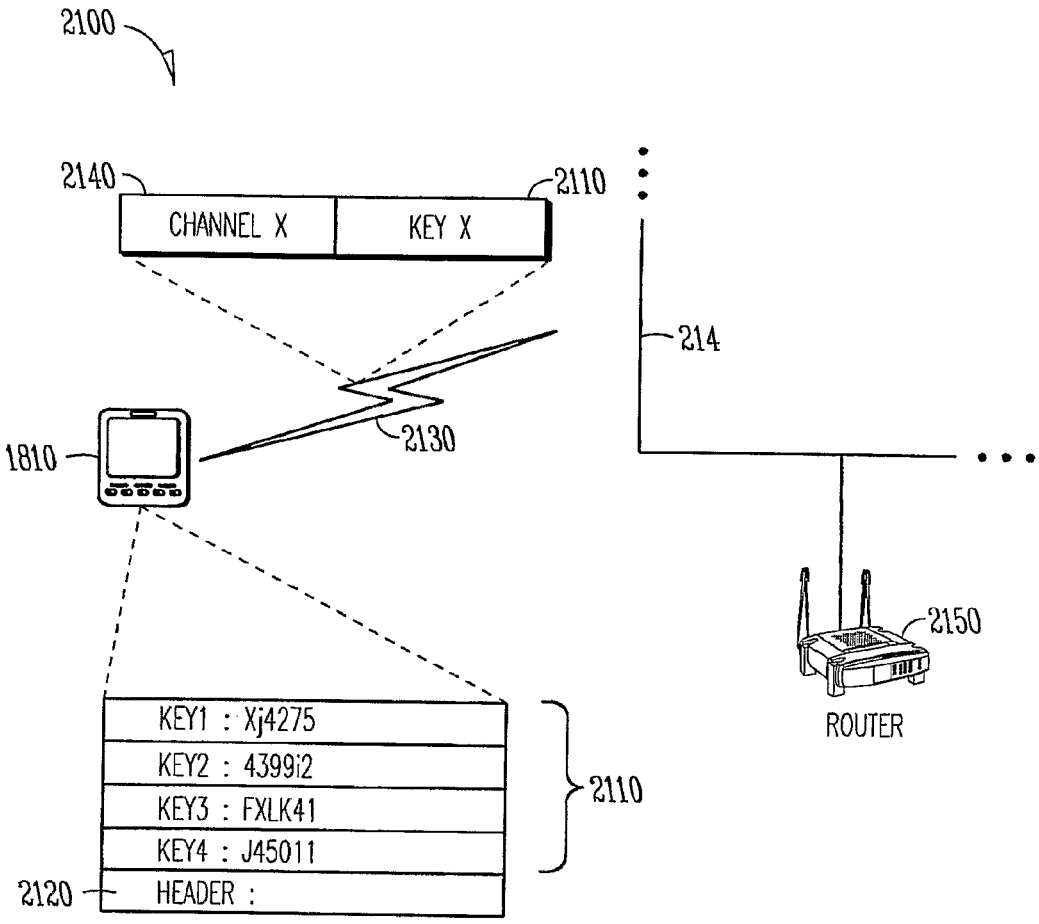

Referring to FIG. 21, according to one embodiment 2100, a wireless player device 1810 may store or obtain four (4) keys 2110, and the protocol header 2120 for network communication 2130 over network 214 identifies which is being used at a particular time. For example, a wireless channel 2140 may be subdivided and protected by a different key, with one key 2110 kept for sending out new keys, to allow changing the keys on a continuous basis. According to one embodiment, a specialized router 2150 is provided to embed this type of key control. According to another embodiment, Internet Protocol security (IPSec) may be used to protect transmissions to and from player's client computer 1810. In one example embodiment, such encryption may result in double encryption, which is very "expensive" in terms of computing power and delay. To reduce delays, this encryption may be done, in one example embodiment, by the radio unit in the wireless access point 245.

According to another example embodiment, there is provided an online poker tournament in the casino where players use their own computing device, such as a laptop, for example authenticated to the network 214 as describe above.

Each of the embodiments described herein are contemplated as falling within the inventive subject matter, which is set forth in the following claims.

The invention claimed is:

1. A computer-implemented method of managing data traffic on a wagering game network, the method comprising:

establishing connections between the network and a plurality of gaming units, wherein each gaming unit includes at least one wagering input unit;

transmitting gaming information to and from the plurality of gaming units via the connections across the network;

monitoring real-time data traffic load conditions at the connections resulting from the transmitted gaming information; and responding to the real-time data traffic load conditions by dynamically routing the gaming information through connections selected to facilitate transmitting gaming information to and from either a high-denomination gaming unit or a gaming unit experiencing a high wager frequency.

2. The method according to claim 1, wherein the network includes routing equipment, and wherein, prior to the dynamic routing of gaming information, the gaming information is routed in data units through the routing equipment based on a priority of the data units.

3. The method according to claim 1, wherein establishing connections includes establishing a plurality of network paths between the gaming units and other network resources.

4. The method according to claim 1, wherein the gaming information is at least a stream of game content to be displayed on at least one of the plurality of gaming units, and further wherein the stream of game content is prioritized based on a player identity.

5. The method according to claim 1, wherein at least some of the gaming information is prioritized based on player perception related to operation of at least one of the plurality of gaming units.

6. A computer-readable, non-transitory medium encoded with instructions for directing a gaming system to perform the method comprising:

establishing connections between a network and a plurality of gaming units located in a gaming establishment, wherein each gaming unit of the plurality includes at least one wagering input unit and wherein the network includes one or more network resources and is connected to at least some of the plurality of gaming units;

transmitting gaming information to and from gaming units of the plurality of gaming units via the connections across the network;

monitoring real-time data traffic load conditions at the connections resulting from the transmitted gaming information; and responding to the real-time data traffic load conditions by dynamically routing the gaming information through connections selected to facilitate transmitting gaming information to and from either a high-denomination gaming unit or a gaming, unit experiencing a high wager frequency.

7. The computer-readable medium of claim 6, wherein the medium resides on a network management server connected for communication to the plurality of gaming units via the network.

8. The computer-readable medium of claim 6, wherein network includes a plurality of network paths and wherein dynamically routing includes directing the gaming information along selected network paths.

9. A gaming system operable to manage data traffic across a wagering game network, the system comprising:

a plurality of gaming units;

one or more network resources coupled to at least one of the plurality of gaming units via a plurality of network paths;

a network management server; and a memory device storing executable instructions that, when executed by the network management server, cause the network management server to operate with the plurality of gaming machines and the one or more network resources to establish connections between the plurality of network paths operable to transmit gaming information to and from the plurality of gaming units;

monitor real-time data traffic load conditions at the connections resulting from the gaming units and the network resources transmitting the gaming information over at least one of the network paths of the plurality of network paths;

in response to the monitored data traffic load conditions, dynamically route the gaming information along one or more specific network paths, wherein the one or more specific network paths are selected to facilitate transmitting gaming information to and from either a high-denomination gaming unit or a gaming unit experiencing a high wager frequency.

10. The gaming system of claim 9, further comprising a plurality of network nodes including network routing equipment.

11. The gaming system of claim 10, wherein the network routing equipment includes one or more or a router, a switch, a hub, and routing software.

12. The gaming system of claim 9, wherein the plurality of network paths includes wireless paths and wherein the connections include wireless access points.

13. A computer-implemented method of managing data traffic in a wagering game network, the method comprising:

establishing connections throughout a plurality of network paths between a plurality of gaming units and other network resources;

transmitting gaming information to and from the gaming units via the network paths of the network;

monitoring real-time data traffic load conditions at the connections resulting from the transmitted gaming information;

in response to the monitored data traffic load conditions, dynamically routing the gaming information via network paths selected to facilitate transmitting gaming information to and from either a high-denomination gaming unit or a gaming unit experiencing a high wager frequency.

14. The method according to claim 13, further including rerouting gaming information using a centralized rerouting process.

15. The method according to claim 13, wherein the connections established with the gaining units include at least a wireless connection provided by a wireless access point, and further wherein the network monitors wireless coverage at least by detecting faults in the wireless access point.

16. The method according to claim 13, wherein the connections established with the gaming units include at least a wireless connection provided by a wireless access point, and further wherein the network dynamically re-routes the gaming information through the wireless access point to establish an active network path for at least one of the gaming units.

17. The method according to claim 13, wherein the network is at least partly formed according to a mesh network topology.

18. The method of claim 13, wherein the plurality of network paths includes one or more wireless paths and the connections include at least one wireless access point, and wherein dynamically routing the gaining information includes directing the gaming information away from the at least one wireless access point.

19. The method according to claim 18, further including monitoring the network using a monitoring server that monitors wireless coverage of the network as well as data traffic load conditions from the at least one wireless access point.

20. The method according to claim 19, including reconfiguring the network such that, in response to the at least one access point being removed from operation, at least one other access point is reconfigured to compensate for the removed at least one access point.

21. The method according to claim 18, wherein the network includes one or more access points and at least one gaming unit operable to provide the network with at least one indication of received signal strength allow the network to determine approximately which areas are weak in signal strength.

22. The method according to claim 18, further including:

supporting one or more of the gaming units from one or more access points on the network; and redeploying at least sonic of the one or more gaming units to different ones of the access points in response to data traffic load conditions.

23. The method of claim 18, wherein establishing connections includes supporting one or more of the gaming units of the plurality via one of the wireless access points, and wherein dynamically routing includes redeploying the one or more gaming units to one or more different ones of the wireless access points.

24. The method of claim 23, wherein dynamically routing is in response to a disruption of service from the one of the wireless access points.

25. The method of claim 13, wherein the connections include at least one of a router, a switch, and a hub.

26. The method of claim 13, wherein the other network resources include one or more of intelligent switches and intelligent routers that facilitate the monitoring of the load conditions and the dynamic routing of the gaming information.

* * * * *

UNITED STATES PATENT AND TRADEMARK OFFICE

CERTIFICATE OF CORRECTION

PATENT NO. : 8,172,684 B2
APPLICATION NO. : 12/097857
DATED : May 8, 2012
INVENTOR(S) : Adiraju et al.

It is certified that error appears in the above-identified patent and that said Letters Patent is hereby corrected as shown below:

On Title page, column 2, abstract, line 7, delete "and a gaming" and insert --and gaming--, therefor In column 5, line 46, delete "overwired" and insert --over wired--, therefor In column 10, line 8, delete "1660A," and insert --1600A,--, therefor In column 12, line 18, after "retina" insert --.--, therefor In column 13, line 42, in claim 6, delete "gaming," and insert --gaming--, therefor In column 14, line 6, in claim 9, delete "paths," and insert --paths of the plurality of network paths,--, therefor In column 14, line 15, in claim 11, delete "or" and insert --of--, therefor In column 14, line 40, in claim 15, delete "gaining" and insert --gaming--, therefor In column 14, line 56, in claim 18, delete "gaining" and insert --gaming--, therefor In column 15, line 4, in claim 21, delete "strength" and insert --strength to--, therefor In column 15, line 10, in claim 22, delete "sonic" and insert --some--, therefor Signed and Sealed this
Nineteenth Day of February, 2013

Teresa Stanek Rea
*Acting Director of the United States Patent and Trademark Office*